US007147511B2

(12) United States Patent
Litz

(10) Patent No.: US 7,147,511 B2
(45) Date of Patent: Dec. 12, 2006

(54) APPARATUS FOR PRODUCTION OF AN ELECTROMAGNETICALLY SHIELDED CONNECTION

(75) Inventor: Alexander Litz, Koenigsbronn (DE)

(73) Assignee: Intergraph Hardware Technologies, Co., Las Vegas, NV (US)

( * ) Notice: Subject to any disclaimer, the term of this patent is extended or adjusted under 35 U.S.C. 154(b) by 0 days.

(21) Appl. No.: 11/084,560

(22) Filed: Mar. 18, 2005

(65) Prior Publication Data

US 2005/0208832 A1 Sep. 22, 2005

(30) Foreign Application Priority Data

Mar. 20, 2004 (DE) ..... 10 2004 013 874

(51) Int. Cl.
*H01R 13/648* (2006.01)

(52) U.S. Cl. ..... 439/607

(58) Field of Classification Search ..... 439/607, 439/939, 378, 609

See application file for complete search history.

(56) References Cited

U.S. PATENT DOCUMENTS 6,347,948 B1 * 2/2002 Hwang ..... 439/92
6,533,612 B1 * 3/2003 Lee et al. ..... 439/607
6,551,138 B1 * 4/2003 Ruque ..... 439/607
6,688,915 B1 * 2/2004 Moriwake et al. ..... 439/607
2002/0012238 A1 1/2002 Takahashi et al. ..... 361/796

FOREIGN PATENT DOCUMENTS

| | | | |
|---|---|---|---|
| DE | 3432789 | A1 | 4/1985 |
| EP | 0 351 070 | A2 | 1/1990 |
| EP | 351070 | A2 * | 1/1990 |
| EP | 0 752 808 | A1 | 1/1997 |
| EP | 1 398 853 | A2 | 3/2004 |
| WO | WO 00/78113 | A1 | 12/2003 |

* cited by examiner

*Primary Examiner*—Tulsidas C. Patel
*Assistant Examiner*—Phuongchi Nguyen
(74) *Attorney, Agent, or Firm*—GrayRobinson, P.A.

(57) ABSTRACT

The invention relates to an apparatus for production of an electromagnetically shielded connection between a plug arrangement (which has at least one plug) of a first unit and a socket arrangement, which has at least one corresponding socket, of a second unit. The at least one plug and the at least one socket form a plug connection when connected to one another. The plug connection is surrounded by a shielding device which provides good electromagnetic shielding for it and is formed by the at least one plug and the at least one socket independently.

27 Claims, 3 Drawing Sheets

APPARATUS FOR PRODUCTION OF AN ELECTROMAGNETICALLY SHIELDED CONNECTION

BACKGROUND OF THE INVENTION

1. Field of the Invention

The invention relates to an apparatus for production of an electromagnetically shielded connection between a plug arrangement (which has at least one plug) of a first unit and a socket arrangement, which has at least one corresponding socket, of a second unit, with the at least one plug and the at least one socket forming a plug connection when connected to one another.

2. Description of the Related Art

The problem of having to electromagnetically shield the connection between a plug and a socket, thus providing an electromagnetically compatible (EMC) plug connection, is known from the general prior art. Electromagnetic shielding is particularly important in the case of radio-frequency data links, that is to say when radio-frequency data transmission is intended to be reliably ensured.

In this context, shielded plug housings are known from the general prior art. In this case, the plug housing is connected to a metallic sheath on the supply cable. Once the plug and the socket, which is provided with a shielded socket housing, have been joined together, this results in electromagnetic shielding. A connection such as this is suitable for manual connection of two cables.

The electromagnetically shielded plug connection which is known from the prior art has, however, been found to be unsuitable when the connection between the plugs and the socket is intended to be made automatically or autonomously without any manual action. This may be the situation, for example, when an electronic unit is intended to be inserted into an adaptor or some other holding device and the plug connection is intended to be made automatically in the final position. In this situation, manufacturing tolerances and wear mean that the plug may not fit exactly in the socket. For this reason, at least the plug or the socket must be secured such that it can move, in order to compensate for the tolerances. However, a moving arrangement of a plug or of the socket according to the prior art has been found to be complex and susceptible to faults.

In order to make it possible to ensure data transmission with as little disturbance as possible, particularly in the case of radio-frequency data transmission, it is necessary for the housings of the two units which are intended to be connected to one another by means of the plug connection to be at the same electrical potential. This requires an electrical connection between the units or the metallic housings of the units. In this context, it is known from the general prior art for the metallically shielded plugs and sockets to be screwed to the housing of the appropriate unit. However, if the plug or the socket is arranged in a floating form and can thus move with respect to the housing of the unit, this connection is no longer reliable. For example, the floating arrangement means that dirt can enter between the contact points, so that an electrical connection is no longer made.

A further solution which is known from the general prior art is for an additional cable to be passed out of the housing of one unit and to be attached to the other unit. However, this solution is complex, susceptible to faults and does not allow an RF-shielded and EMC-shielded connection.

It is more complex to produce a reliable electromagnetically shielded plug connection as the number of plug connections and/or plug/socket pairs between the units to be connected together increases, particularly when floating suspension is required for this purpose.

Radio-frequency data transmission is used, for example, for so-called hard disk stores or flight data recorders in which the data obtained from a digital camera is stored during a photographic flight of an aircraft. This data may, for example, be image data, supplementary data relating to the images, such as mission data, system information or general information for post-processing. The flight data recorder is in general in the form of a bulk memory for the "digital mapping camera".

Electrically and mechanically, every flight data recorder is an autonomous unit which is connected to the digital camera via an image data connection.

Every storage unit in the aircraft is mechanically secured, and is electrically connected to all the necessary cables in a further operation. After landing, the flight data recorder is removed, and the image data is copied to a ground-based bulk memory.

The known flight data recorders have the disadvantage that the plug connection between the flight data recorder and the cable which continues further is cumbersome, and is often very difficult owing to the confined spatial conditions in the aircraft. This is particularly true for high data transmission rates. Incorrect connection of cables can in this case lead to a malfunction. It is also particularly important in this case for the plug connection to be reliable, in particular to be resistant to vibration and impacts, since, otherwise, there is a risk of accidental disconnection of the connection owing to the aircraft movements which take place in flight.

SUMMARY OF THE INVENTION

The present invention is based on the object of providing an electromagnetically shielded connection between at least one plug and one socket, in particular when they are each connected to an electronic unit, with the apparatus being intended to ensure in a physically simple manner a permanent and reliable electromagnetic shielding even when the connection is regularly disconnected.

According to the invention, this object is achieved by the descriptive part of claim 1.

The shielding device according to the invention separates the function of "electromagnetic shielding" from the function of "electrical connection". The solution according to the invention allows an entire plug or socket arrangement to be electromagnetically shielded by means of a shielding device which is independent of the plugs and sockets, irrespective of the number of plugs and sockets. In this case, the configuration of the plugs and/or of the sockets, the number of poles or whether the plugs and/or the sockets is or are mounted in a floating or fixed form are irrelevant. The plugs and the sockets can thus be suspended as required in a flexible or floating form without this adversely affecting the electromagnetic shielding.

The solution according to the invention can be implemented easily and at low cost. The separation of the electromagnetic shielding from the actual plug connection means that there is no wear on the electromagnetic shielding as a result of the contact being made between the plugs and the sockets, and the electromagnetic shielding is not adversely affected by this. Furthermore, this results in permanently reliable shielding of the connection.

A further advantage of the solution according to the invention is that the shielding device can be connected to the housing of the unit which contains the plugs or the sockets in a simple manner, for example via a screw connection or else via any other desired connection technique. This connection is in this case independent of whether the plugs and/or sockets are suspended in a flexible or floating form. This ensures that the housings of the units which are connected together via the plug connection are at the same electrical potential. This therefore reliably avoids potential differences between the housings, and thus the injection of interference.

The apparatus according to the invention makes it possible to form the plugs and the sockets in a particularly cost-effective manner from just plastic There is no longer any need for any costly metallically shielded housing for each plug and each socket.

It is advantageous that the electromagnetic shielding device can be assembled from a first shielding element, which surrounds the plug arrangement, and a second shielding element which surrounds the socket arrangement.

In this case, the invention provides for the two shielding elements to make good electromagnetic contact with one another when the at least one plug makes contact with the at least one socket. It is thus possible in a simple manner for the first shielding element to be electromagnetically well connected to the first unit, and for the second shielding element to be electromagnetically well connected to the second unit. This may be achieved, for example, by means of a screw connection or any other connection technique. As soon as the first shielding element now makes contact with the second shielding element, that is to say when the plug connection between the plug and the socket is closed, this results, in addition to the shielding, in an electrical connection between the first and the second unit, thus matching their electrical potentials.

One design refinement of the invention also provides for the at least one plug to be connected to a first mount element which is provided with the first shielding element, and for the at least one socket to be connected to a second mount element which is connected to the second shielding element.

The mount elements allow an arrangement which is independent of the units. It is thus possible, for example, for the first mount element to be attached by means of the first shielding element in a floating form to the housing of the unit that is provided. The second mount element can likewise be attached to the housing of the other unit in a floating form or such that it cannot move. The attachment of the mount elements to the respective unit allows an electromagnetically shielded connection to be provided for this housing in a simple manner. These shielding elements with which the mount elements are provided result, in the manner which has already been described, in electromagnetically good shielding for the plug connections as well as an electrical connection between the housings of the two units.

It is advantageous for the at least one plug to be detachably connected to the first mount element, and for the at least one socket to be detachably connected to the second mount element. In this case, it is also advantageous for the at least one plug and/or the at least one socket to be connected in a floating or flexible form to the respective mount element. A floating or flexible arrangement of at least one plug and/or of a corresponding socket has been found to be advantageous in order to compensate for any tolerances in the mating of the plug connection. Since the electromagnetic shielding and the equalization of the potentials on the housings of the two units are independent of a floating arrangement, of the plugs and/or of the sockets, the disadvantages described with the prior art do not occur in this case.

It is advantageous for at least one mount element to be connected in a floating form to the associated unit, and for the mount elements each to have mutually corresponding guide elements in order to connect them to one another in a defined manner.

The mount element, which is arranged in a floating form, may, for example, be essentially in the form of a plate and may have a projecting rim which is connected by means of spring elements, which are known from the general prior art, in a floating or flexible form to the associated unit.

The flexible suspension of at least one of the two mount elements makes it possible for the shielding elements of the mount elements which form the electromagnetic shielding device to be aligned appropriately with respect to one another. In this case, in an experiment, it has been found that the floating suspension of one of the two mount elements is sufficient for this purpose. The other mount element may in this case likewise be in the form of a plate, but is connected to the associated unit such that it cannot move.

The shielding elements of the two mount elements may, for example, each be in the form of a metal sheath, which surrounds the respectively associated plug or socket arrangement, and/or is arranged circumferentially around it. One possible embodiment of the shielding element may also comprise this shielding element being formed from protrusions which run essentially linearly, are arranged essentially in the form of a rectangle with one another, and surround the plug or socket arrangement. A further alternative refinement of the shielding element may, for example, comprise the mount element being in the form of a plate, with a projecting plate rim being provided, which surrounds the plug or the socket arrangement and is in the form of a shielding element.

There are a large number of possible ways to refine the shielding elements, leading to the plug connections being surrounded in the form of a tunnel by electromagnetic shielding The plug connections are thus located within shielding that is formed by the shielding elements.

In one refinement of the shielding elements, as protrusions or as a plate rim, it has been found to be advantageous for them to have contact springs, or to be in the form of contact springs. The contact springs may in this case be formed, for example, as curved sheet-metal elements. An embodiment composed of beryllium/copper has been found to be particularly suitable for this purpose.

Advantageous refinements and developments of the invention can be found in the further dependent claims. Exemplary embodiments of the invention will be described, fundamentally, in the following text with reference to the drawings.

DETAILED DESCRIPTION

Figure 1:
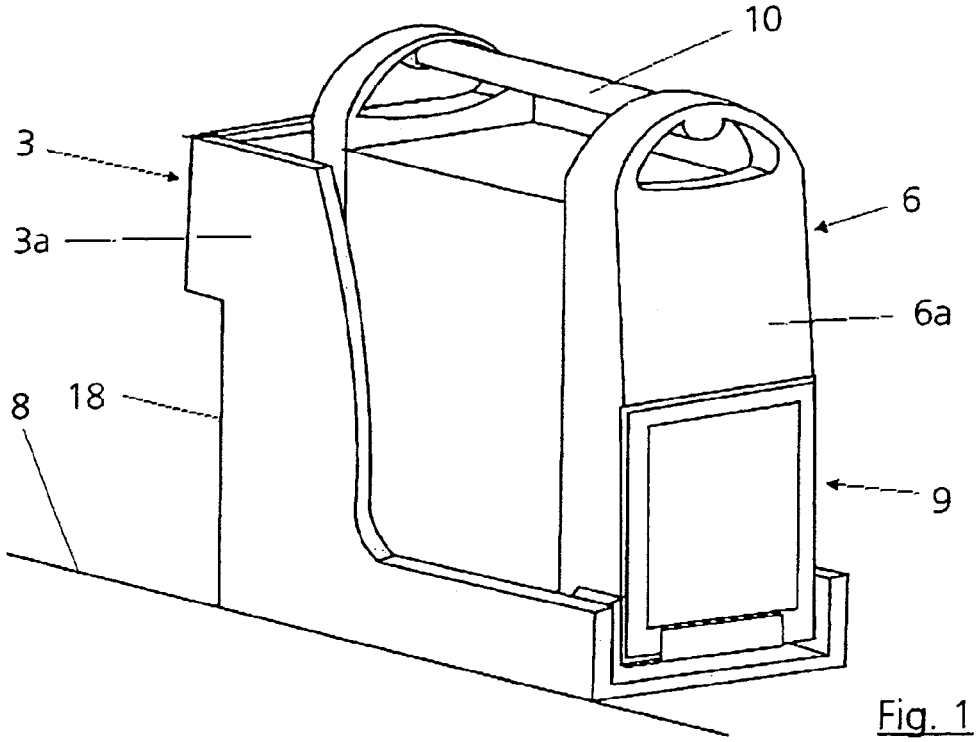
FIG. 1 shows a perspective illustration of a first unit in the form of an adaptor with a second unit inserted, in the form of a flight data recorder.

The exemplary embodiment which relates to an apparatus for production of an electromagnetically shielded connection between a plug arrangement 2 (which has at least one plug 1) of a first unit 3 and a socket arrangement 5 (which has at least one corresponding socket 4) of a second unit 6. The first unit 3 and the second unit 6 may be in the form of any desired technical appliances which make contact via plug connections 7 that are formed by plugs 1 and sockets 4.

The second unit 6 may, for example, be in the form of a laptop, with the first unit 3 being a charging or connection station. The first unit 3 may also be in the form of a general equipment cabinet or a system unit, for example, for medical purposes, in which a corresponding portable second unit 6, for example a system element, a medical appliance or the like, is inserted. There are no limits in this case on the configuration of the first unit 3 and/or of the second unit 6. The apparatus according to the invention can be used for any desired technical appliances which are intended to be electronically connected to one another.

Figure 3:
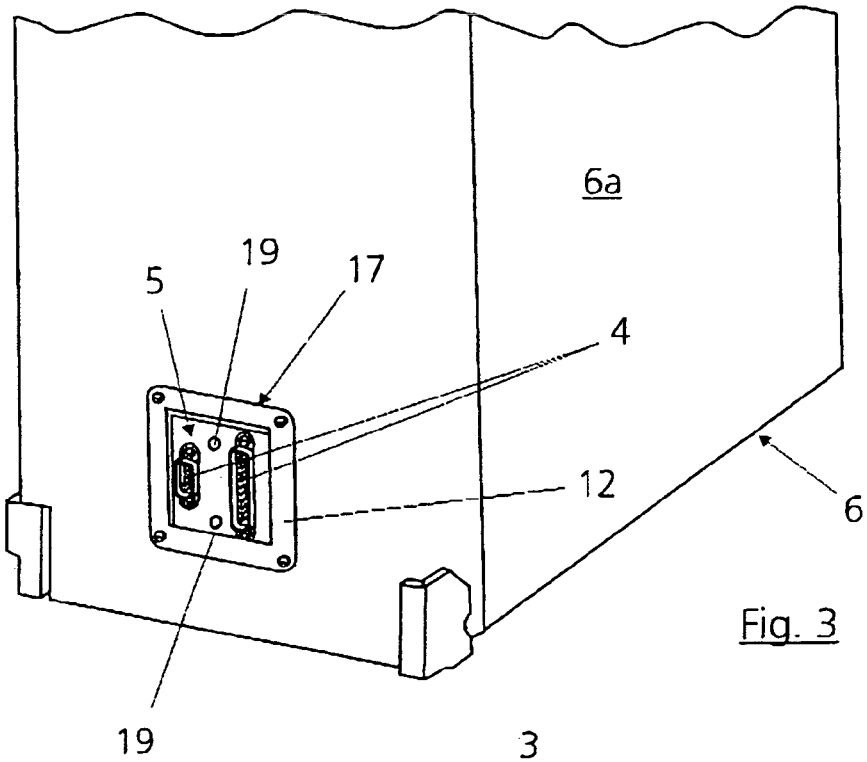
FIG. 3 shows a view of a socket arrangement of the second unit, with the sockets being screwed to a second mount element which is provided with the second shielding element.

As can be seen from FIG. 3, the second unit in the exemplary embodiment is in the form of a flight data recorder 6 in which data obtained from a digital camera (which is not illustrated in any more detail) can be stored during a photographic flight by an aircraft 8. The second unit 3 is in this case in the form of an adaptor 3 which is suitable for holding the flight data recorder 6, with the adaptor 3 being electrically and mechanically connected to the aircraft 8.

The flight data recorder 6 may, for example, contain two or more storage media (not illustrated), possibly as well as further system components. Digital cameras for recording such data have been known for a long time from the general prior art, and will therefore not be described in any more detail in the exemplary embodiment.

To the extent that the elements described in the exemplary embodiment are already known from the general prior art, they will not be described in any more detail in the following text. Only those features which are significant to the invention will be described in the following text.

As can be seen from FIG. 1, the flight data recorder 6 is connected or braced to the adaptor 3 by means of a locking device 9. For ease of handling and insertion of the flight data recorder 6, it is provided with a handle 10 on its upper face. If two more storage media are arranged in the flight data recorder 6, then they are thus held together by the handle 10 and/or the housing 6*a* of the flight data recorder 6 to form a replaceable unit.

Electrically and mechanically, the flight data recorder 6 is in the form of an autonomous unit which is connected via an image data connection to a digital camera which is not illustrated in any more detail. Furthermore, a monitoring data input, a monitoring data output and a supply voltage input as well an image data interface are provided.

FIG. 3 shows said connections as well as inputs and outputs in the form of the socket arrangement 5. The sockets 4 are in this case intended to make contact with the plugs 1 shown in FIGS. 2 and 4, thus making a corresponding number of plug connections 7. In the exemplary embodiment, the plug arrangement 2 of the adaptor 3 has two plugs 1. Analogously to this, the socket arrangement 5 of the flight data recorder 6 likewise has two sockets 4. The plugs 1 and the sockets 4 are intended for radio-frequency data transmission. The plugs 1 and the circuits 4 have a large number of poles.

Figure 2:
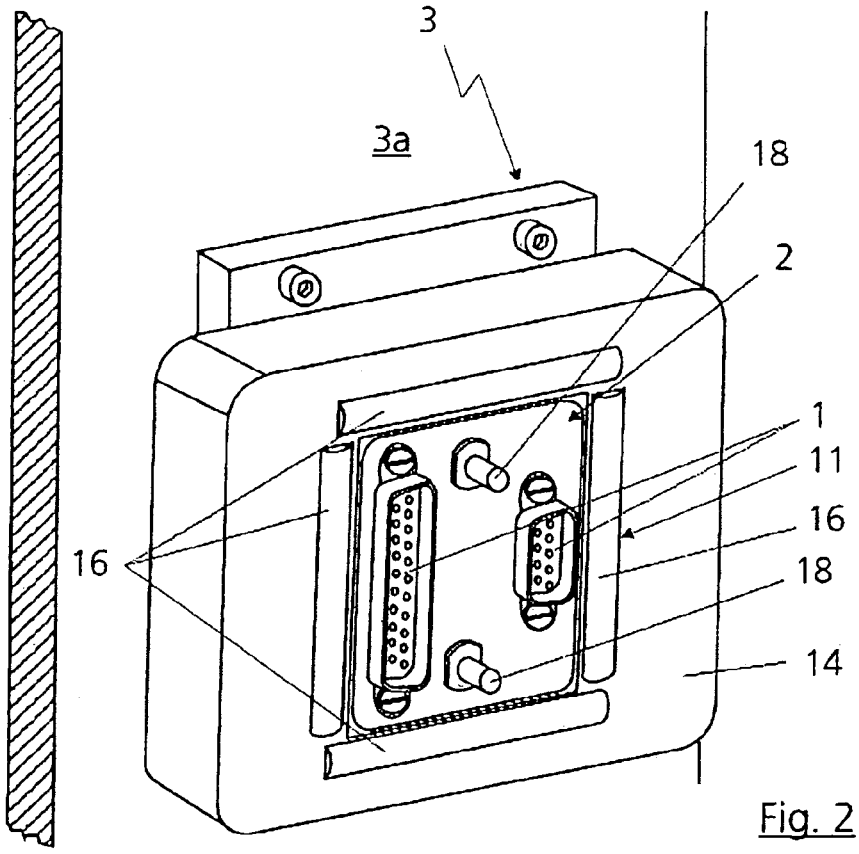
FIG. 2 shows a view of a plug arrangement of the first unit, with the plugs being screwed to a first mount element which is provided with a first shielding element.

As is evident from joint consideration of FIGS. 1 to 3, the socket arrangement 5 of the flight data recorder 6 is arranged on a rear face of the flight data recorder 6, facing away from the locking device 9. The plug arrangement 2 of the adaptor 3 is in this case arranged in a rear wall of the adaptor 3, which is adjacent to the rear wall of the flight data recorder 6 when this is inserted En the adaptor 3 and is appropriately locked. The exemplary embodiment provides for the flight data recorder 6 to be inserted into the adaptor 3 and then to be pushed in the direction of the rear wall of the adaptor 3 by the locking device 9, so that the plugs 1 and the sockets 4 make contact with one another. Appropriate locking of the locking device 9 prevents the flight data recorder 6 from being able to move in the opposite direction again. The plugs 1 and the sockets 4 thus reliably make contact with one another.

Since contact is made between the plugs 1 and the sockets 4 without any manual assistance, this results in the configuration of the plug arrangement 2 and of the socket arrangement 5 as described in the following text with reference to FIGS. 2 to 4.

Figure 4:
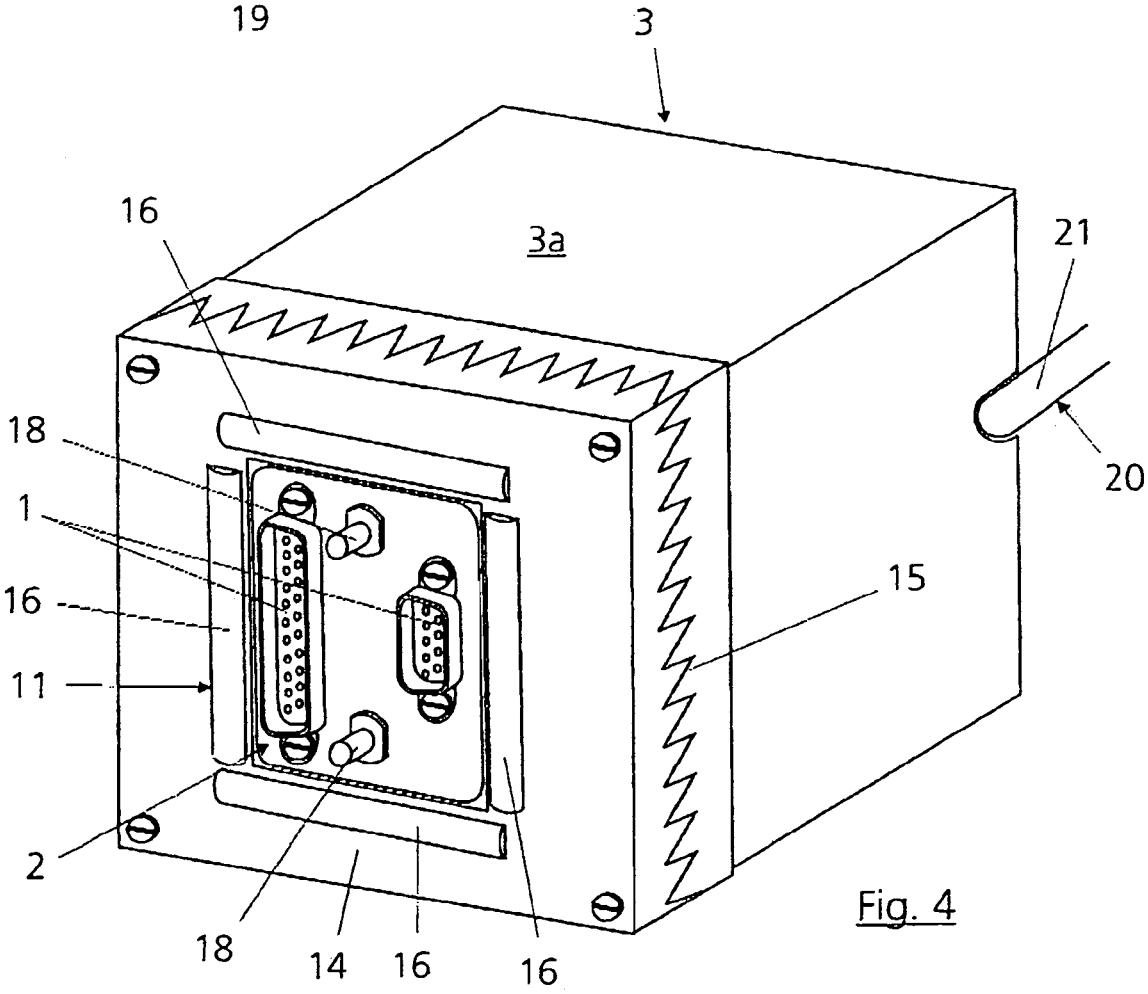
FIG. 4 shows an outline illustration of the first mount element in an alternative embodiment to that shown in FIG. 2, with the first mount element being connected in a floating form to the second unit.

As can be seen from FIGS. 2 to 4, the plug arrangement 2 is surrounded by a first shielding element 11, and the socket arrangement 5 is surrounded by a second shielding element 12, with the shielding elements 11, 12 electromagnetically making a good contact with one another and the plug connections 7 providing electromagnetic shielding between the plugs 1 and the sockets 4 when the plugs 1 and sockets 4 are in contact with one another.

Figure 5:
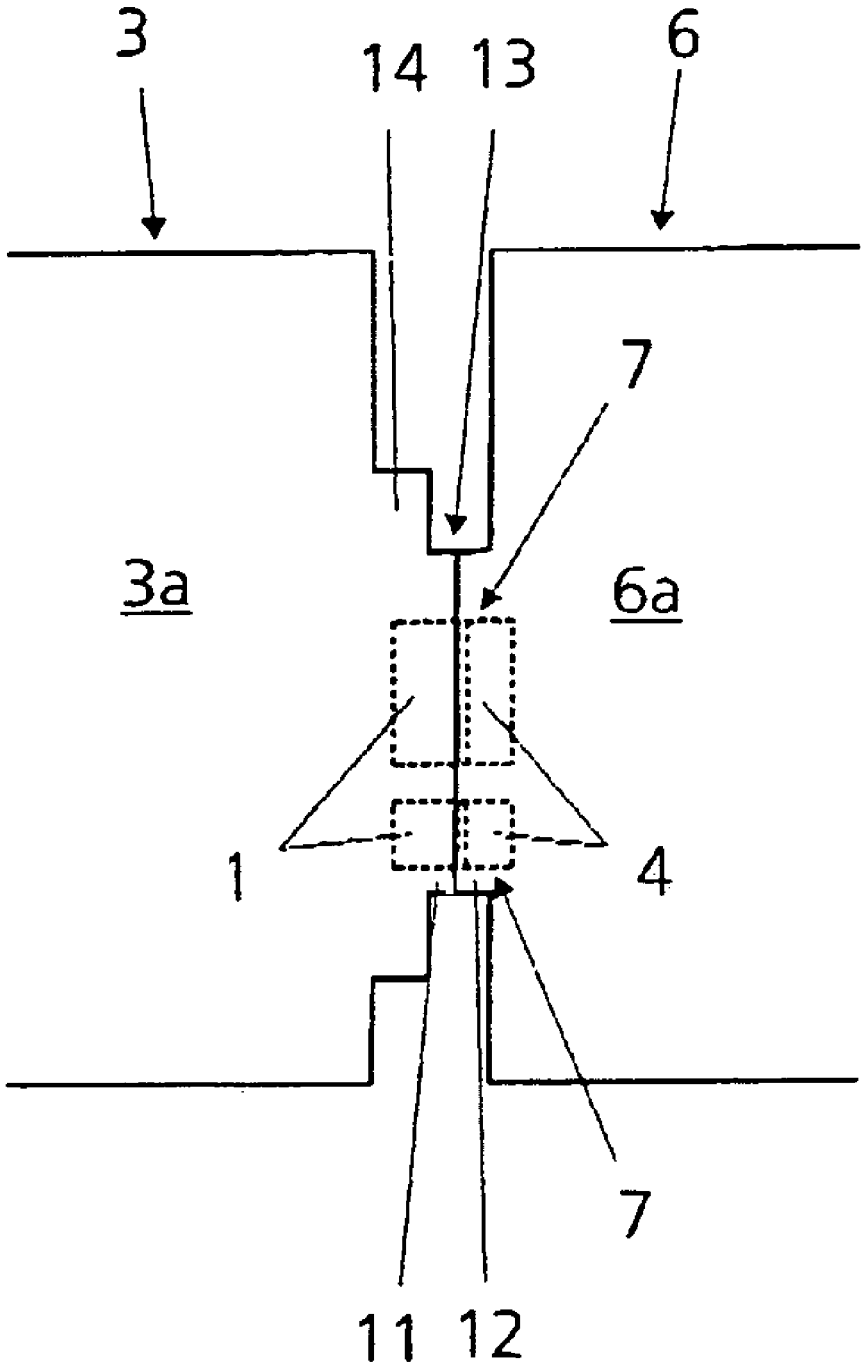
FIG. 5 shows an outline illustration in which the two units are connected to one another via plug connections and the shielding elements form a shielding device which electromagnetically shields the plug connections.

The shielding elements 11, 12 thus form a shielding device 13 which provides good electromagnetic shielding for the plug connections 7. In this case, the shielding device 13 surrounds the plug connections 7, but is completely independent of both the plugs 1 and the sockets 4. In the exemplary embodiment, the electromagnetic shielding device 13 is composed of the first shielding element 11, which surrounds the plug arrangement 2, and the second shielding element 12, which surrounds the socket arrangement 5. In this case, FIG. 5 shows an outline illustration of how contact is made between the first shielding elements 11 and the adaptor 3 and the second shielding element 12 of the flight data recorder 6.

As can be seen from FIG. 2 and FIG. 4, the plugs 1 are connected to a first mount element 14. The first mount element 14 is in this case essentially in the form of a plate with a bent rim. As can be seen from the outline illustration in FIG. 4, the bent rim on the first mount element 14 can in this case be arranged in a floating or flexible form on the adaptor 3. A floating arrangement as has been known from the general prior art for a long time is chosen for this purpose. This is illustrated in an outline form in FIG. 4, on the basis of the spring elements 15.

As can be seen from FIG. 2 and FIG. 4, the invention provides for the plugs 1 to be screwed to the flat surface of the first mount element 14 by means of a screw connection. In this case, provision is made for the plugs 1 to be connected in a floating or flexible form to the first mount element 14. The plug arrangement 2 which is formed from the plugs 1 is surrounded by the first shielding element 11. The first shielding element 11 may in this case be, for example, in the form of a circumferential rim, raised area, bead or protrusion. As can be seen from FIG. 2 and FIG. 4, the first shielding element 11 in the exemplary embodiment is essentially in the form of linearly running protrusions 16, which are essentially arranged in the form of a rectangle with respect to one another and surround the plug arrangement 2. The protrusions 16 are in this case aligned with the second shielding element 12 of the flight data recorder 6. The protrusions 16 in the exemplary embodiment are in the form of contact springs which are flexible and/or flex within certain limits with the second shielding element 12 while contact is being made. The contact springs may, for example, be in the form of bent sheet-metal strips composed of beryllium/copper.

The floating arrangement of the first mount element 14 and the adaptor 3 results in a floating or flexible arrangement of the first shielding element 11.

As can be seen from FIG. 3, the sockets 4 are connected to a second mount element 17, which is provided with the second shielding element 12. The sockets 4 are in this case detachably connected to the second mount element 17 by means of a screw connection. The second mount element 17 is essentially in the form of a plate and is connected to the second unit 6 such that it cannot move. A screw connection is provided in the exemplary embodiment, for this purpose. The second mount element 17 has a raised circumferential plate rim which surrounds the sockets 4 of the socket arrangement 5, which are screwed to the second mount element 17. The plate rim is in this case used as the second shielding element 12, which makes contact with the protrusions 16 on the first shielding element 11 as soon as the plug connections 7 that are formed from sockets 4 and plugs 1 are mated. The second shielding element 12, which is in the form of a plate rim, may have contact springs and/or may be in the form of contact springs.

As can be seen from FIG. 3, the invention also provides for the sockets 4 to be connected in a floating or flexible form to the second mount element 17.

As can be seen from FIG. 2 and FIG. 3, the mount elements 14, 17 each have mutually corresponding guide elements 18, 19 in order to make a defined connection to one another. In this case, the first mount element 14 has guide pins 18, and the second mount element 17 has guide holes 19. The guide pins 18 and the guide holes 19 result in the shielding elements 11, 12 as well as the plugs 1 and the sockets 4 making contact in the intended position. Any tolerances which may be present are in this case compensated for by the floating suspension of the first mount element 14, or the floating suspension of the plugs 1 and of the sockets 4. The guide pins 18 and the guide hole 19 in this case provide guidance, so that the plugs 1 and the sockets 4 can make contact virtually without any bending loads.

The exemplary embodiment provides for the cables 20 which lead to the plugs 1 and to the sockets 4 to have a sheath 21 which is or can be electrically connected to the mount elements 14, 17 directly, via the housing 6*a* of the flight data recorder 6, or via the housing 3*a* of the adaptor 3. In this context, FIG. 4 shows one,possible embodiment for this purpose. In this case, the sheath 21 on the cable 20 is electrically connected to the housing 3*a* of the adaptor 3. Analogously to this, but in a manner which is not illustrated in any more detail, a sheath 21 on a cable 20 which is connected to a socket 4 can be connected either directly to the second mount element 17 or to the housing 6*a* of the flight data recorder 6.

The data to be transmitted is shielded appropriately by the sheath 21 on the cable 20 that is illustrated in FIG. 4. The sheath 21 is in this case connected to the housing 3*a*, providing electromagnetic shielding. The housing 3*a* is electrically connected via the spring element 15 to the first mount element 14, and is electromagnetically shielded on the outside. The first mount element 14 is connected to the second mount element 17 via the shielding device 13 (when the plugs 1 are making contact with the sockets 4), so that external electromagnetic shielding is also provided in this area. The second mount element 17 is in this case connected to the housing 6*a* of the flight data recorder 6 via a screw connection. This therefore also ensures electromagnetic shielding here. The housing 6*a* of the flight data recorder 6 in the exemplary embodiment is formed from metal and provides external electromagnetic shielding for the interior and for the system elements which are arranged in the interior of the housing 6*a*.

The sheath (which is not illustrated in any more detail) on the cables which continue further from the sockets 4 of the flight data recorder 6 can be electrically connected either directly to the second mount element 17 or to the housing 6*a*.

The described connection in addition to the electromagnetic shielding means that the housings 3*a* and 6*a* are at the same electrical potential, thus eliminating one possible interference source. The housings 3*a* and 6*a* are at the same electrical potential because they are electrically connected via the mount elements 14, 17 and the shielding device 13.

The solution according to the invention solves two problems, firstly providing electromagnetic shielding or EMC shielding for the plug connection, while on the other hand keeping the housings of the two mated units 3, 6 at the same electrical level.

A large number of possible ways to connect the sheath 21 of the cable 20 to the housing 3*a* or 6*a* are obvious from the general prior art.

By way of example, the plugs 2 and the sockets 4 may be in the form of D-SUB plugs or sockets.

The shielding device 13 and all of the elements which are intended for electromagnetic shielding are, in the exemplary embodiment, formed from metal. The described exemplary embodiment is not restricted to the illustrated embodiment.

What is claimed is:

1. An apparatus for production of an electromagnetically shielded connection between a first unit and a second unit, the first unit being of the type having a plug arrangement which includes at least one plug, the second unit being of the type having a socket arrangement, which includes at least one corresponding socket, the at least one plug and the at least one socket forming a plug connection when connected to one another, said apparatus, comprising:

an electromagnetic shield peripherally surrounding said plug connection, said shield including a first shielding element mounted to the first unit, and a second shielding element mounted to the second unit, said first shielding element being formed of an electromagnetic shielding material and having a first surface which substantially completely circumferentially surrounds said plug arrangement, said second shielding element being formed of an electromagnetic shielding material and having a second surface which substantially completely circumferentially surrounds said socket arrangement, said first surface and said second surface being positioned to mutually oppose one another and to make substantially complete circumferential contact with one another over an area circumferentially surrounding the plug connection when said at least one socket are connected to one another;

said first shielding element and said plug arrangement being mounted to said first unit sufficiently mechanically independently of one another and said second shielding element and said socket arrangement being mounted to said second unit sufficiently mechanically independently of one another as to permit relative movement between said electromagnetic shield and said plug connection when said at least one plug and said at least one socket are connected to one another.

2. The apparatus as claimed in claim 1, wherein the two shielding elements make good electromagnetic contact with one another when the at least one plug makes contact with the at least one socket.

3. The apparatus as claimed in claim 1, wherein the first shielding element forms a good electromagnetic connection to the first unit, and the second shielding element forms a good electromagnetic connection to the second unit.

4. The apparatus as claimed in claim 1, wherein the first shielding element and/or the second shielding element are in the form of a circumferential rim, projection, raised area, bead or protrusion.

5. The apparatus as claimed in claim 1, wherein at least one of said first shielding element and said second shielding element is connected to its associated first unit or second unit, respectively by way of a mount which is movable with respect to said unit.

6. The apparatus as claimed in claim 1, wherein the plug arrangement in each case has at least two plugs, and the socket arrangement in each case has at least two sockets.

7. The apparatus as claimed in claim 1, wherein the cables which lead to the plugs and to the sockets have metallic sheath which is or can be electromagnetically well connected to the respectively associated shielding element directly or via the associated mount elements, or via the associated unit.

8. The apparatus as claimed in claim 1, wherein the interior of the first unit and/or of the second unit are/is electromagnetically well shielded by means of a metallic housing, in which case the metallic housing is or can be electromagnetically well connected to the respectively associated shielding element.

9. The apparatus as claimed in claim 1, wherein the plugs and the sockets are intended for radio-frequency data transmission.

10. The apparatus as claimed in claim 1, wherein the plugs and the sockets have a large number of poles.

11. The apparatus as claimed in claim 1, wherein the second unit includes a metallic housing to which said second shielding element is mounted by way of an electromagnetically shielded mounting element.

12. The apparatus as claimed in claim 1, further comprising a cable for providing an electrical connection to said at least one socket, at least a portion of said cable extending exteriorly of the second unit, at least said portion of said cable having a metallic sheath which is electrically connected to the second shielding element via an electromagnetically shielded path.

13. The apparatus as claimed in claim 1, wherein the second unit is in the form of a portable flight data recording in which data obtained from a digital camera can be stored during a photographic flight of an aircraft.

14. The apparatus as claimed in claim 13, wherein the first unit is in the form of an adaptor which is suitable for holding the flight data recorder, with the adaptor being electrically and/or mechanically connected to the aircraft.

15. The apparatus as claimed in claim 1, wherein the at least one plug is connected to a first mount element which provided with the first shielding element, and the at least one socket is connected to a second mount element which is provided with the second shielding element.

16. The apparatus as claimed in claim 15, wherein the at least one plug is detachably connected to the first mount element, and the at least one socket is detachably connected to the second mount element.

17. The apparatus as claimed in claim 15, wherein the at least one plug and/or the at least one socket are/is connected movably to the respective mount element.

18. The apparatus as claimed in claim 15, wherein the at least one socket is connected movably to said second mount element.

19. The apparatus as claimed in claim 15, wherein the first mount element and the second mount element are each provided with mutually corresponding guide elements for defined connection to one another.

20. The apparatus as claimed in claim 19, wherein the first mount element has guide pins, and the second mount element has guide holes.

21. The apparatus as claimed in claim 15, wherein the first mount element is essentially in the form of a plate and is connected in a floating form to the first unit, with the first shielding element being formed from essentially linearly running protrusions, which are arranged essentially in the form of a rectangle with respect to one another and surround the plug arrangement.

22. The apparatus as claimed in claim 21, wherein the second mount element is essentially in the form of a plate and is connected to the second unit such that it cannot move, with the second shielding element being in the form of a plate rim which surrounds the socket arrangement.

23. The apparatus as claimed in claim 21, wherein the protrusions on the first mount element and/or the second shielding element, which is in the form of a plate rim, on the second mount element have contact springs and/or are in the form of contact springs.

24. An apparatus for the production of an electromagnetically shielded plug connection between (i) a first unit having a plug arrangement which includes at least one plug, and (ii) a second unit having a socket arrangement which includes at least one corresponding socket, the plug connection being produced when said at least one plug and said at least one socket are connected to one another, said apparatus comprising:

a) an electromagnetic shielding device which sufficiently surrounds the plug connection to provide good electromagnetic shielding for the plug connection, said electromagnetic shielding device being formed by the at least one plug and the at least one socket independently, said electromagnetic shielding device comprising a first shielding element which surrounds the plug arrangement and a second shielding element which surrounds the socket arrangement, said first shielding element being formed from substantially linearly running protrusions arranged substantially in the form of a rectangle with respect to one another and surrounding the plug arrangement, b) a first mount element connected to the at least one plug, said first mount element being provided with said first shielding element and being essentially in the form of a plate connected in a floating form to the first unit, and c) a second mount element connected to the at least one socket, said second mount element being provided with said second shielding element.

25. An apparatus as claimed in claim 24, wherein said second mount element is substantially in the form of a plate connected immovably to the second unit and wherein said second shielding element is in the form of a plate rim which surrounds the socket arrangement.

26. The apparatus as claimed in claim 24, wherein said protrusions comprise contact springs.

27. The apparatus as claimed in claim 24, wherein said plate rim comprises a contact spring.

* * * * *